United States Patent [19]

Kaneko et al.

[11] 4,394,169

[45] Jul. 19, 1983

[54] HIGH STRENGTH AUSTENITE STEEL HAVING EXCELLENT COLD WORK HARDENABILITY

[75] Inventors: Koji Kaneko; Yoshihide Fuchino; Tsuyoshi Inoue, all of Kobe, Japan

[73] Assignee: Kabushiki Kaisha Kobe Seiko Sho, Kobe, Japan

[21] Appl. No.: 377,842

[22] Filed: May 13, 1982

[30] Foreign Application Priority Data

May 15, 1981 [JP] Japan ..... 56-72997

[51] Int. Cl.[3] ..... C22C 38/02

[52] U.S. Cl. ..... 75/128 A; 75/126 B

[58] Field of Search ..... 75/128 A, 126 B

[56] References Cited

U.S. PATENT DOCUMENTS

| | | | |
|---|---|---|---|
| 2,711,959 | 6/1955 | DeLong | 75/128 A |
| 2,789,049 | 4/1957 | DeLong | 75/126 B |
| 2,949,355 | 8/1960 | Dyrkacz et al. | 75/126 B |

*Primary Examiner*—L. Dewayne Rutledge
*Assistant Examiner*—Debbie Yee
*Attorney, Agent, or Firm*—Oblon, Fisher, Spivak, McClelland & Maier

[57] ABSTRACT

Disclosed herein is high strength austenitic steel having excellent cold work hardenability, consisting essentially of the following elements:

C . . . 0.1–0.3 wt. %;
Si . . . up to 1.5 wt. %;
Mn . . . 16–22 wt. %;
Cr . . . 14–18 wt. %;
V . . . 0.8–1.7 wt. %;
N . . . 0.3–0.6 wt. %;
Ni . . . below 0.8 wt. %; and
Fe and inevitable impurities . . . balance, with a proviso that the C-, N- and V-contents satisfy the following inequalities:

$C+N-(V/10) \geqq 0.4$ wt. %; and
$C+N+V/5 \geqq 0.75$ wt. %.

The above austenitic steel may further contain at least one element selected from the group consisting of 0.05–1.0 wt. % of Ti and 0.05–1.0 wt. % of Nb. The above high strength austenitic steel has an extremely high 0.2% proof stress, exhibits excellent resistance to stress corrosion cracking and good hot workability, and maintains its non-magnetic properties.

3 Claims, 9 Drawing Figures

HIGH STRENGTH AUSTENITE STEEL HAVING EXCELLENT COLD WORK HARDENABILITY

BACKGROUND OF THE INVENTION (1) Field of the Invention

This invention relates to high strength austenitic steel having excellent cold work hardenability, i.e., capable of developing a 0.2% proof stress of 130 kgf/mm$^2$ or higher when hardened through cold working. More specifically, it relates to high strength austenite steel having excellent cold work hardenability and suitable as a material for generator retaining rings and the like.

(2) Description of the Prior Art

It is generally required for materials adapted for fabrication of generator retaining rings that they be non-magnetic to avoid drops in the efficiency of power generation and, in addition, that they meet ever-increasing demands for strength to cope with the trend of capacity increase of power generators. Cold worked 0.5C-18Mn-5Cr steel is presently used to fabricate such retaining rings.

Although 0.5C-18Mn-5Cr steel has a high degree of strength, it still involves a problem in that it develops stress corrosion cracking through its repeated use over a long period of time. It has been confirmed through experiments that its resistance to stress corrosion cracking is considerably lowered by moisture deposition although the mechanism of this stress corrosion cracking has not yet been completely elucidated.

As a potential solution to the problem of stress corrosion cracking of retaining rings, high Cr steel (Cr content: 13 wt.% or more) having excellent resistance to general corrosion has been attracting considerable attention. However, such high Cr steel is accompanied by a drawback in that its C-content must be maintained at a lower level to avoid the formation of Cr carbides because any abundant Cr-content promotes the formation of Cr carbides and the resultant steel is reduced in its resistance to general corrosion to the same level as low Cr steel.

A lower C-content makes it difficult to highly strengthen steel through its cold working at 350° C. or lower. Thus, a very high degree of processing and working is indispensable to harden low C-Mn-Cr steel to a 0.2% proof stress of at least 100 kgf/mm$^2$, leading to another problem that it is difficult to fabricate retaining rings of desired quality with such low C-Mn-Cr steel.

SUMMARY OF THE INVENTION

An object of this invention is to provide, as a material suitable for the fabrication of generator retaining rings, high strength austenite steel having good resistance to stress corrosion cracking and excellent cold work hardenability so as to obviate the aforementioned problems and drawbacks of the conventional steel for such retaining rings. A particular object of this invention is to provide high strength austenitic steel having excellent cold work hardenability and capable of developing a 0.2% proof stress of 130 kgf/mm$^2$ or higher, and more specifically of 130–165 kgf/mm$^2$.

As a result of an extensive research carried out by the present inventors, it was found that an incorporation of alloying elements, which are excellent in work hardenability, would provide high strength steel having excellent cold work hardenability. Based on this finding, the inventors studied through experiments the 0.2% proof strengths of a variety of steel compositions which contained various alloying elements and had been subjected to cold working at temperatures up to 350° C. The above study has turned out to another finding that an existence of C, V and N in combination renders steel highly strong.

According to one aspect of this invention, there is thus provided high strength austenitic steel having excellent cold work hardenability, which steel consists essentially of the following elements:

C . . . 0.1–0.3 wt.%;
Si . . . up to 1.5 wt.%
Mn . . . 16–22 wt.%;
Cr . . . 14–18 wt.%;
V . . . 0.8–1.7 wt.%;
N . . . 0.3–0.6 wt.%;
Ni . . . below 0.8 wt.%; and
Fe, and inevitable impurities . . . balance, with a proviso that the C-, N- and V-contents satisfy the following inequalities:

$C+N-(V/10) \geqq 0.4$ wt.%; and
$C+N+(V/5) \geqq 0.75$ wt.%.

In another aspect of this invention, the above high strength austenite steel may further contain at least one element selected from the group consisting of 0.05–1.0 wt.% of Ti and 0.05–1.0 wt.% of Nb.

The high strength austenite steel having excellent cold work hardenability, according to the present invention, has many advantages, including an extremely high 0.2% proof stress, maintenance of non-magnetic properties, excellent resistance to stress corrosion cracking, and good hot workability.

The above and other objects, features and advantages of the present invention will become apparent from the following description and the appended claims, taken in conjunction with the accompanying drawings, in which all designations of percent refer to percent by weight, unless specified otherwise.

DETAILED DESCRIPTION OF THE INVENTION AND PREFERRED EMBODIMENTS

The high strength austenitic steel having excellent cold work hardening (hereinafter referred to as "the steel" according to this invention) contains, as mentioned above, a variety of alloying elements. The significance and preferred content range of each of such alloying elements will hereinafter be described.

Figure 1:
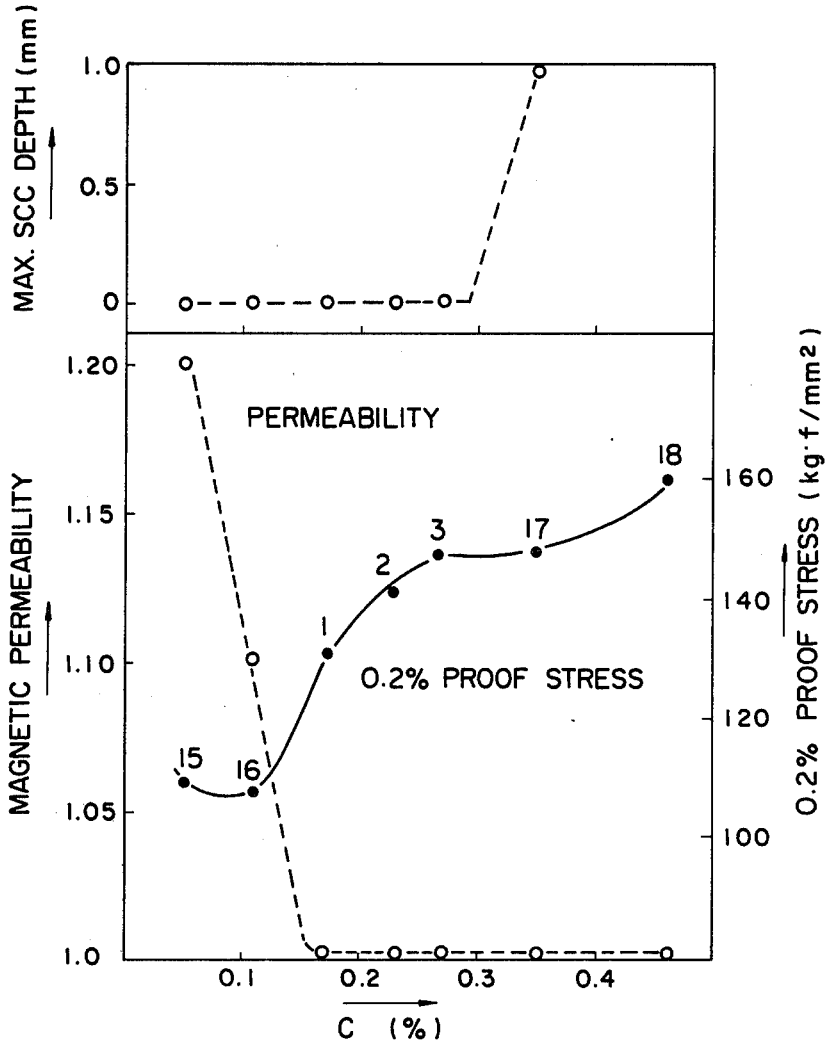
FIG. 1 illustrates diagrammatically the effect of C-content on the 0.2% proof stress, magnetic permeability and max. SCC (stress corrosion cracking) depth of C-18%Mn-15%Cr-0.4%N-1.15%V steel after cold work hardening.

The element C is incorporated to form stable austenite steel and to impart strength thereto. As shown in FIG. 1 which was obtained by plotting data on C-18%Mn-15%Cr-0.4%N-1.15%V steel, any C-contents less than 0.15% make the resultant steel magnetic and lowers its 0.2% proof stress considerably. On the other hand, the curve in FIG. 1 is shifted parallelly toward the left and the lower limit of the C-content comes down as its N-content increases. Thus, in view of the content range of the element N which will be described later, the lower limit of the C-content should be set at 0.1%. This means that, when increasing the N-content to its upper limit, the lower limit of the C-content should be 0.1% to give satisfactory 0.2% proof stress and non-magnetic properties. On the other hand, any C-content beyond 0.3% deteriorates resistance to stress corrosion cracking. Thus, the C-content should be limited to 0.1–0.3%.

Figure 2:
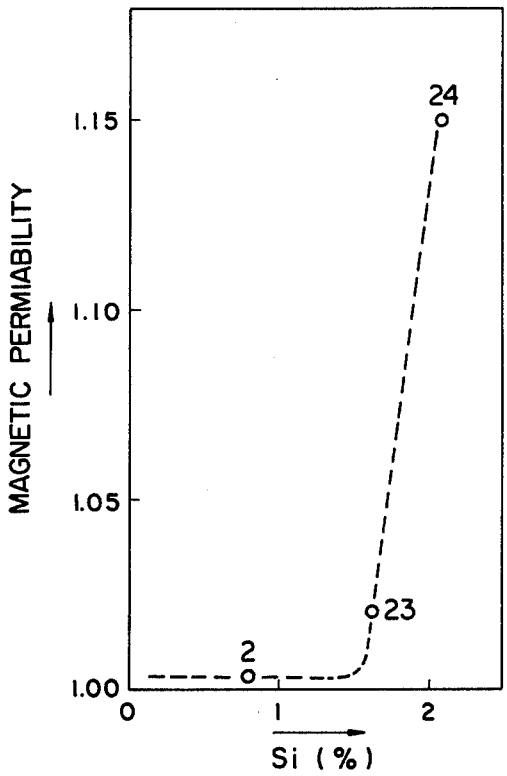
FIG. 2 is a graph showing the relation between the Si content in 0.2%C-18%Mn-15%Cr-0.4%N-1.1%V steel after cold work hardening and its magnetic permeability.

The element Si is necessary as a deoxidizing agent but its content should not exceed 1.5% because otherwise the steel will no longer be non-magnetic, after cold work hardening as shown in FIG. 2. Consequently, the Si-content should be up to 1.5%.

Figure 3:
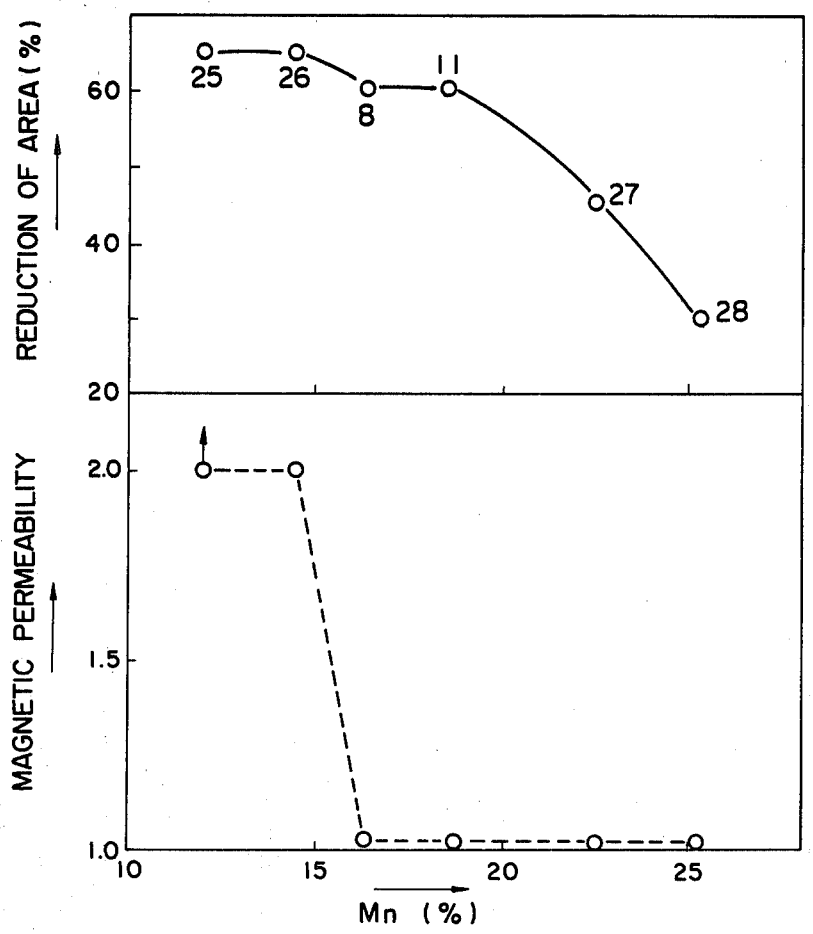
FIG. 3 shows diagrammatically the influence of the Mn-content on the magnetic permeability of 0.2%C-Mn-15%Cr-0.4%N-1.0%V steel after cold work hardening and on the reduction of area determined in a hot tension test at 1000° C. useing the same steel after hot forging.

The element Mn is required to provide austenitic steel having stable non-magnetic properties even after cold working. As seen in FIG. 3, the non-magnetic properties will be lost after cold working if its content is less than 16%. On the other hand, any Mn-contents exceeding 22% will result in considerably deteriorated hot workability and occurrence of forge cracking. Accordingly, the Mn-content should be in the range of 16–22%.

Figure 4:
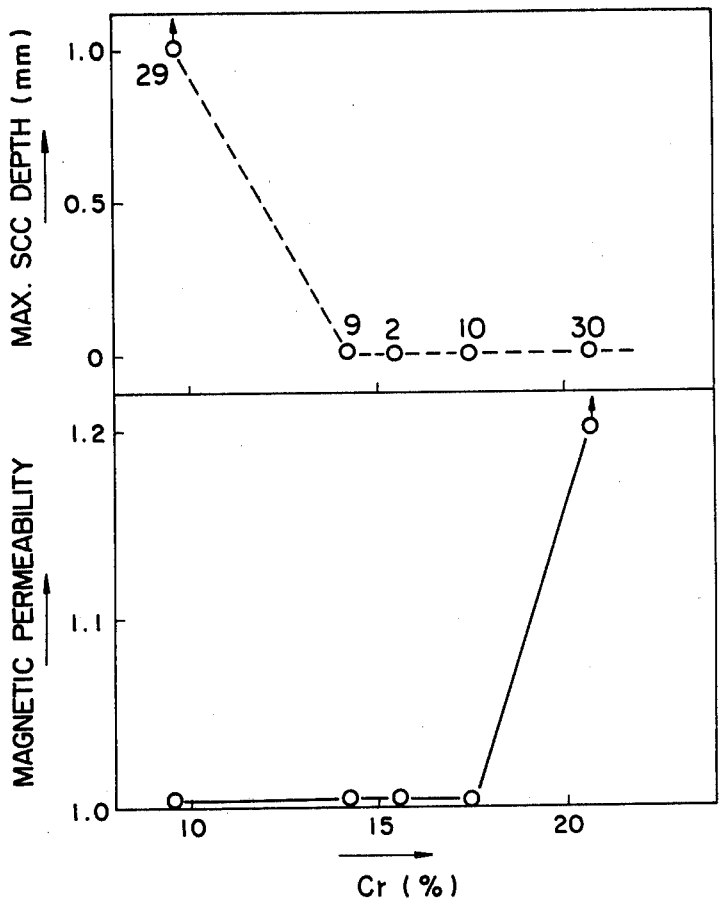
FIG. 4 is a graph showing max. SCC depth of 0.2%C-18%Mn-Cr-0.4%N-1.1%V steel after cold work hardening and its magnetic permeability in relation to the Cr-content.

Turning now to the element Cr which imparts resistance to general corrosion, it should be contained in the range of 14–18%. As shown in FIG. 4, the resistance to stress corrosion cracking will be deteriorated when the Cr-content is less than 14%. On the other hand, any Cr-content beyond 18% will make the resulting steel lose its non-magnetic properties and will render its austenite phase unstable due to the formation of Cr carbides and/or Cr nitrides.

Figure 5:
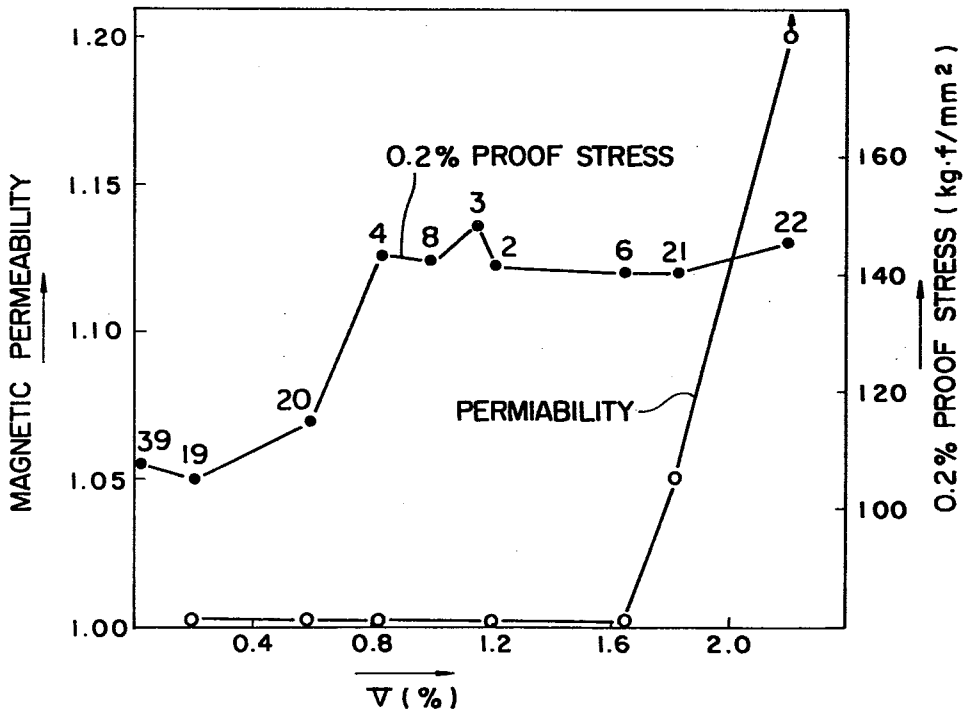
FIG. 5 is a graph illustrating the dependence of the 0.2% proof stress of 0.2%C-18%Mn-15%Cr-0.4%N-V steel after cold work hardening and its magnetic permeability upon the V-content.

The element V is effective to form precipitations and to provide improved strength after work hardening due to its grain refining effect. It is a particularly important element for increasing the cold work hardenability at temperatures below 350° C. As seen in FIG. 5, any V-contents less than 0.8% will result in significantly lowered 0.2% proof stress whereas, when contained beyond 1.7%, it will decrease the amounts of C and N present as solid solution and contribute to the stability of the austenite phase and the resultant steel will lose its non-magnetic properties. Thus, the V-content should range from 0.8 to 1.7%.

Figure 6:
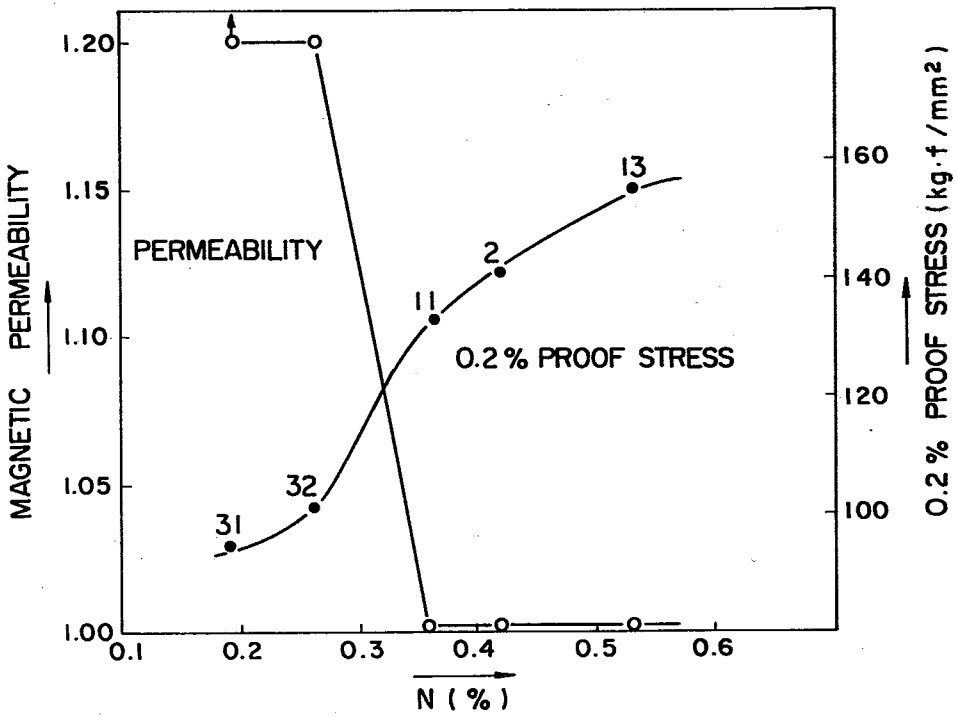
FIG. 6 depicts diagrammatically the effect of N-content on the 0.2% proof stress of 0.2%C-18%Mn-15%Cr-N-1.1%V steel after cold work hardening and its magnetic permeability.

Similar to the element C, the element N is effective to stabilize the austenite phase of steel and to enhance its strength after work hardening. As readily envisaged from FIG. 6 which was obtained by plotting data on 0.2%C-18%Mn-15%Cr-N-1.1%V steel, any N-content of less than 0.35% fails to give desired 0.2% proof stress and makes the resultant steel lose its non-magnetic properties. However, the curve in FIG. 6 will be shifted parallelly toward the left and the lower limit of the N-content will come down as the C-content increases. In view of the aforementioned content range of the element C, the lower limit of the element N should be 0.3%. This means, in other words, that the lower limit of the element N, which limit satisfies both 0.2% proof stress and non-magnetic property, should be 0.3% when the C-content is increased to its upper limit, i.e., 0.3%. Steel will develop cracks during its forging and show deteriorated hot workability, as Steel No. 33 shown in TABLES 1 and 2 which will appear later, when the element N is incorporated in any amounts beyond 0.6%. Consequently, the N-content should be in the range of 0.3–0.6%.

Figure 7:
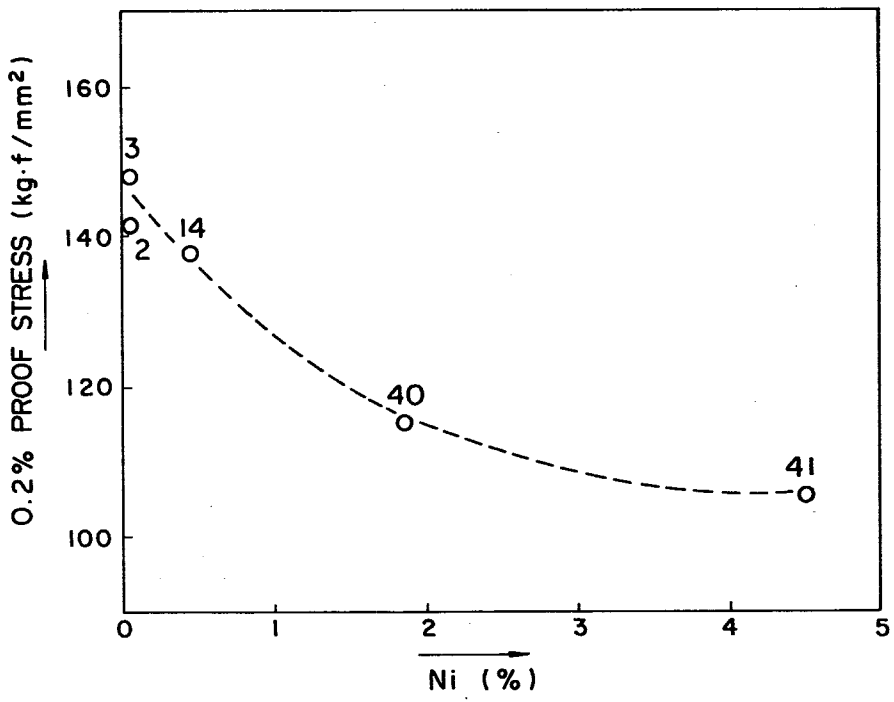
FIG. 7 illustrates diagrammatically the relation between the Ni-content in 0.2%C-18%Mn-15%Cr-0.4%N-1.1%V-Ni steel after cold work hardening and its 0.2% proof stress.

The element Ni serves to stabilize the non-magnetic properties of steel and, at the same time, to lower its cold work hardenability. As apparent from FIG. 7, the element Ni induces lowered 0.2% proof stress when too much is added. Thus, it is desirable to limit the Ni-content as much as possible. In the present steel, where the main objective is to provide high strength, the Ni-content should be kept below 0.8% so as to give desired 0.2% proof stress. Preferred Ni-contents are less than 0.6%.

If a 0.2% proof stress of 100 kgf/mm$^2$ *l or lower is sought, it can be achieved even with steel containing no V and N by cold working the same steel. However, to obtain a higher* 0.2% proof stress, for example, of 130 kgf/mm$^2$ or higher, an extremely high reduction ratio is indispensable unless all the elements C, N and V are contained in combination. Such a high reduction ratio will certainly make the working of the resultant steel very difficult. After extensive research by the present inventors, it has been found that the elements C, N and V are closely correlated for providing high strengh steel having excellent cold work hardenability and stabilized non-magnetic properties. Namely, it has been found that, among the elements C, N and V, the following inequalities must be satisfied respectively to stabilize the non-magnetic properties of steel and to provide high strength of a desired 0.2% proof strength:

$C+N-(V/10) \geqq 0.4\%$; and $C+N+(V/5) \geqq 0.75\%$.

In other words, a steel composition area falling within the above component range of each of the elements and satisfying both of the above inequalities provides steel having high strength and stable non-magnetic properties.

Figure 8:
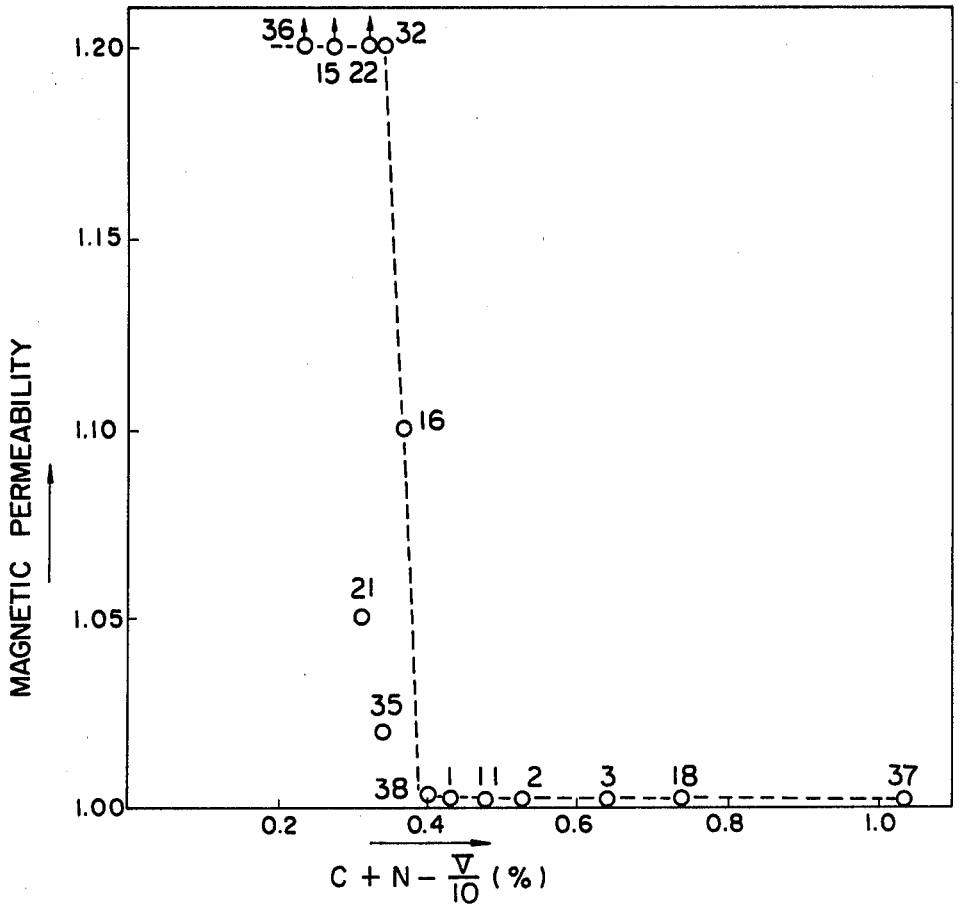
FIG. 8 is a graph illustrating the relation between the content of C+N−(V/10) in C-18%Mn-15%Cr-N-V steel after cold work hardening and its magnetic permeability.

FIG. 8 is, as mentioned above, a graph showing the relation between the content of C+N−(V/10) in C-18%Mn-15%Cr-N-V steel after cold work hardening and its magnetic permeability. The elements C and N serve to stabilize an austenite phase to almost the same extent. As apparent from TABLES 1 and 2, which will appear later in this specification, and FIG. 8, an incorporation of 0.17%C-0.26%N fails to provide non-magnetic properties as Steel No. 32 but non-magnetic properties are imparted when the N-content is increased as in Steel No. 1 which contains 0.17%C-0.38%N. However, the element V promotes the formation of precipitations and makes the austenite phase unstable. Steel No. 38, scarce in the V-content, is non-magnetic while Steel No. 32, abundant in the V-contant, is magnetic, although both of the steel samples contain the elements C and N in similar low levels. As has been described above, the elements C, N and V are closely correlated with respect to magnetic permeability and it is thus very important for the stabilization of non-magnetic properties to satisfy the above inequality, i.e., $C+N-(V/10)\geqq 0.4\%$.

Figure 9:
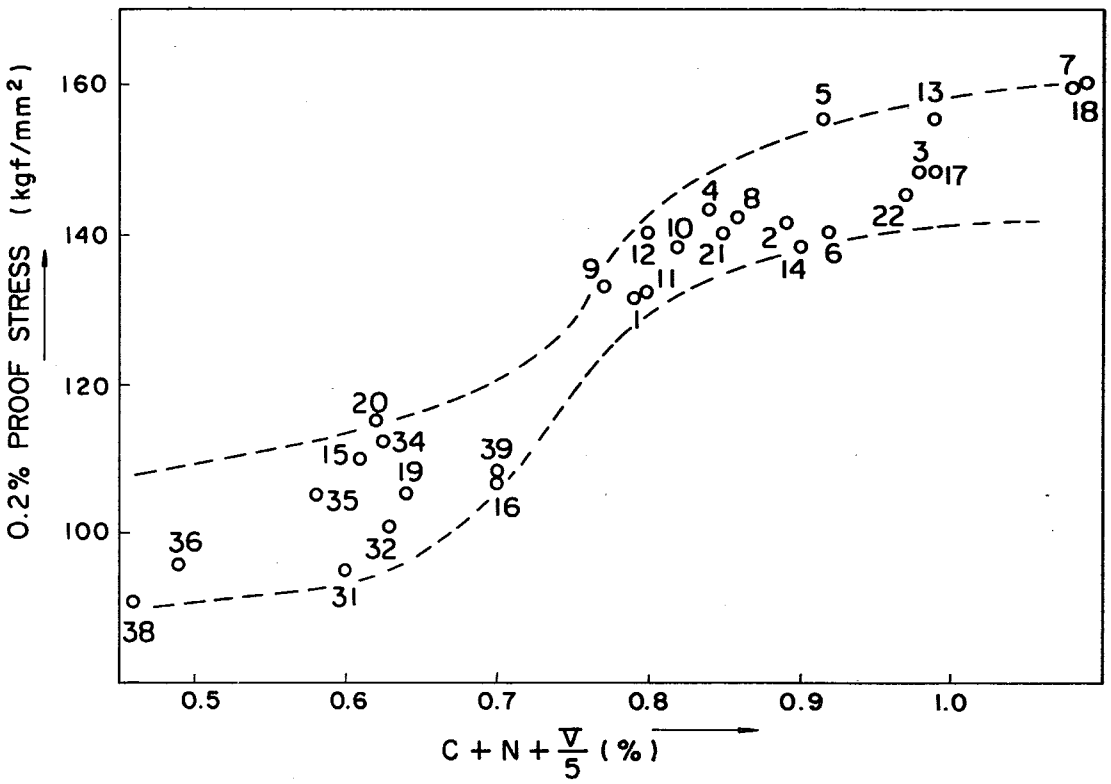
FIG. 9 illustrates diagrammatically the relation between the content of C+N+(V/5) in C-18%Mn-15%Cr-N-V steel after cold work hardening and its 0.2% proof stress.

Referring now to FIG. 9 which is, as mentioned above, a diagrammatic illustration of the relation between the content of $C+N+(V/5)$ in C-18%Mn-15%Cr-N-V steel after cold work hardening and its 0.2% proof stress. The elements C, N and V serve to provide an increased degree of strength after subjecting steel to cold working. The effectiveness of the element V is one fifth of that of the elements C or N. Low strength, non-magnetic steel does not require the elements C, N and V in high contents, but it is important for steel of a 0.2% proof stress of 130 kgf/mm$^2$ or higher to contain the elements $C+N+(V/5)$ in an amount of at least 0.75%, and preferably 0.8% or more.

No satisfactory 0.2% proof stress is obtained with Steel No. 37 in which the overall content of $C+N+(V/5)$ is higher than 0.8% but the V-content is lower than 0.8%. To obtain the present austenite steel having high strength and non-magnetic properties, it is necessary, as mentioned above, to satisfy not only the permissible content range of each element but also both of the inequalities, i.e., $C+N-(V/10)\geqq 0.4\%$ and $C+N+(V/5)\geqq 0.75\%$.

The present steel may contain, as an additional element, at least one of the elements Ti and Nb. These elements are effective to make the austenitic grains of steel finer and thus to enhance its strength further. Where they are incorporated, their preferred content ranges are each 0.05–1.0%.

Certain examples of steel according to this invention will hereinafter be described in conjunction with some comparative steel.

EXAMPLE

TABLE 1 shows the chemical compositions of steels according to this invention (hereinafter referred to as "present steel") and comparative steels. TABLE 2 shows, with respect to each of the present steel and comparative steel, the overall content of $C+N-(V/10)(\%)$, the overall content of $C+N+(V/5)(\%)$, and the test results on the 0.2% proof stress, magnetic permeability, and max. and SCC depth through the U-bend test after subjection to cold working to give the same true strain level ($\epsilon=0.3$) and hot workability.

The 0.2% proof stress, magnetic permeability and max. SCC depth after effecting cold working to give the true strain level ($\epsilon=0.3$) as well as the hot workability, all given in TABLE 2, were determined as follows.

Raw materials were proportioned and smelted by an ordinary method to give each of the steel samples shown in TABLE 1. The resultant melted steel was thereafter processed through casting, ingot making, hot forging and, after heated at 1150° C. for 1 hour, water cooled, subjected to mechanical working, and cold rolled to give $\epsilon=\ln(l/l_o)=0.3$ in which $l_o$ and $l$ mean respectively the lengths before and after the cold rolling in accordance with usual procedures. Each specimen was then subjected to mechanical processing to determine its characteristics. The 0.2% proof stress was determined at room temperature after machining each specimen into a JIS (Japan Industrial Standard) No. 4 test piece. The magnetic permeability was measured substantially following ASTM A 342 Method No. 1. The stress corrosion cracking test was conducted on U-bend test pieces which had been immersed for one week in a 3.5% aqueous NaCl solution of 70° C. The hot workability was rated by the presence of cracks during hot forging and/or from the evaluation of reduction of area after carrying out a hot tension test at 1000° C. subsequent to hot forging.

TABLE 1

| | Steel No. | Chemical Composition (wt. %) C | Si | Mn | Cr | N | Ni | V | Others |
|---|---|---|---|---|---|---|---|---|---|
| Invention | 1 | 0.17 | 0.51 | 19.1 | 15.1 | 0.38 | 0.05 | 1.19 | — |
| | 2 | 0.23 | 0.78 | 18.7 | 15.5 | 0.42 | 0.05 | 1.21 | — |
| | 3 | 0.27 | 0.63 | 18.8 | 15.3 | 0.48 | 0.04 | 1.15 | — |
| | 4 | 0.20 | 0.61 | 19.3 | 16.1 | 0.48 | 0.04 | 0.82 | — |
| | 5 | 0.21 | 0.51 | 18.6 | 15.4 | 0.53 | 0.03 | 0.84 | — |
| | 6 | 0.20 | 0.53 | 18.9 | 15.5 | 0.39 | 0.03 | 1.65 | — |
| | 7 | 0.26 | 0.66 | 19.1 | 15.9 | 0.56 | 0.04 | 1.29 | — |
| | 8 | 0.25 | 0.62 | 16.3 | 15.7 | 0.41 | 0.03 | 0.99 | — |
| | 9 | 0.20 | 0.55 | 18.5 | 14.2 | 0.35 | 0.04 | 1.08 | — |
| | 10 | 0.23 | 0.48 | 18.6 | 17.5 | 0.37 | 0.04 | 1.11 | — |
| | 11 | 0.23 | 0.59 | 18.5 | 15.5 | 0.36 | 0.04 | 1.07 | — |
| | 12 | 0.20 | 0.63 | 18.3 | 15.0 | 0.42 | 0.05 | 0.91 | — |
| | 13 | 0.26 | 0.55 | 18.7 | 15.3 | 0.53 | 0.03 | 1.01 | — |
| | 14 | 0.26 | 0.53 | 19.0 | 15.7 | 0.44 | 0.45 | 1.01 | — |
| Comparative | 15 | 0.05 | 0.49 | 19.2 | 15.4 | 0.33 | 0.04 | 1.17 | — |
| | 16 | 0.11 | 0.55 | 18.9 | 15.2 | 0.37 | 0.04 | 1.10 | — |
| | 17 | 0.35 | 0.58 | 19.2 | 16.0 | 0.43 | 0.03 | 1.02 | — |
| | 18 | 0.46 | 0.55 | 19.3 | 15.5 | 0.40 | 0.06 | 1.17 | — |
| | 19 | 0.21 | 0.51 | 18.7 | 15.0 | 0.39 | 0.05 | 0.20 | — |
| | 20 | 0.18 | 0.60 | 19.1 | 16.2 | 0.32 | 0.05 | 0.59 | — |
| | 21 | 0.19 | 0.55 | 18.8 | 15.9 | 0.30 | 0.05 | 1.82 | — |
| | 22 | 0.21 | 0.69 | 18.6 | 15.1 | 0.32 | 0.04 | 2.20 | — |
| | 23 | 0.18 | 1.65 | 18.5 | 16.2 | 0.39 | 0.05 | 1.08 | — |
| | 24 | 0.20 | 2.11 | 18.8 | 15.5 | 0.40 | 0.05 | 1.11 | — |
| | 25 | 0.23 | 0.68 | 12.0 | 15.8 | 0.35 | 0.04 | 1.09 | — |
| | 26 | 0.22 | 0.75 | 14.5 | 15.4 | 0.31 | 0.03 | 1.13 | — |
| | 27 | 0.19 | 0.62 | 22.3 | 16.2 | 0.38 | 0.04 | 1.00 | — |
| | 28 | 0.27 | 0.51 | 25.1 | 15.3 | 0.49 | 0.05 | 1.03 | — |
| | 29 | 0.26 | 0.48 | 19.8 | 9.5 | 0.30 | 0.05 | 1.05 | — |
| | 30 | 0.18 | 0.63 | 18.9 | 20.7 | 0.38 | 0.05 | 1.10 | — |
| | 31 | 0.19 | 0.51 | 18.8 | 15.6 | 0.19 | 0.04 | 1.08 | — |
| | 32 | 0.17 | 0.64 | 18.2 | 15.4 | 0.26 | 0.04 | 1.02 | — |
| | 33 | 0.18 | 0.70 | 19.1 | 15.4 | 0.76 | 0.04 | 1.15 | — |
| | 34 | 0.30 | 0.71 | 19.8 | 16.8 | 0.10 | 0.03 | 1.23 | — |
| | 35 | 0.22 | 0.70 | 18.8 | 15.5 | 0.20 | 0.03 | 0.81 | — |
| | 36 | 0.14 | 0.58 | 18.6 | 15.2 | 0.18 | 0.04 | 0.87 | — |
| | 37 | 0.59 | 0.61 | 19.2 | 15.7 | 0.44 | 0.03 | 0.02 | — |
| | 38 | 0.17 | 0.66 | 18.3 | 15.2 | 0.25 | 0.06 | 0.20 | — |
| | 39 | 0.25 | 0.60 | 18.8 | 15.1 | 0.45 | 0.04 | 0.02 | — |
| | 40 | 0.24 | 0.51 | 19.1 | 16.1 | 0.36 | 1.95 | 1.00 | — |
| | 41 | 0.22 | 0.55 | 19.0 | 15.5 | 0.35 | 4.50 | 0.98 | — |
| Invention | 42 | 0.18 | 0.75 | 19.8 | 15.7 | 0.56 | 0.04 | 1.25 | Ti 0.22 Nb 0.50 |
| | 43 | 0.21 | 0.69 | 18.9 | 15.2 | 0.45 | 0.05 | 0.87 | Ti 0.17 |

TABLE 2

| | Steel No. | $C + N - \frac{V}{10}$ % | $C + N + \frac{V}{5}$ % | After cold working ($\epsilon = 0.3$) 0.2% Proof stress kgf/mm² | Permeability | Max. Scc depth mm | Hot Workability |
|---|---|---|---|---|---|---|---|
| Invention | 1 | 0.43 | 0.79 | 131 | <1.005 | 0 | A |
| | 2 | 0.53 | 0.89 | 141 | <1.005 | 0 | A |
| | 3 | 0.64 | 0.98 | 148 | <1.005 | 0 | A |
| | 4 | 0.60 | 0.84 | 143 | <1.005 | 0 | A |
| | 5 | 0.66 | 0.91 | 155 | <1.005 | 0 | A |
| | 6 | 0.43 | 0.92 | 140 | <1.005 | 0 | A |
| | 7 | 0.69 | 1.08 | 159 | <1.005 | 0 | A |
| | 8 | 0.56 | 0.86 | 142 | <1.005 | 0 | A |
| | 9 | 0.44 | 0.77 | 133 | <1.005 | 0 | A |
| | 10 | 0.49 | 0.82 | 138 | <1.005 | 0 | A |
| | 11 | 0.48 | 0.80 | 132 | <1.005 | 0 | A |
| | 12 | 0.53 | 0.80 | 140 | <1.005 | 0 | A |
| | 13 | 0.69 | 0.99 | 155 | <1.005 | 0 | A |
| | 14 | 0.60 | 0.90 | 138 | <1.005 | 0 | A |
| Comparative | 15 | 0.26 | 0.61 | 110 | >2.0 | 0 | A |
| | 16 | 0.37 | 0.70 | 107 | 1.10 | 0 | A |
| | 17 | 0.58 | 0.98 | 148 | <1.005 | 1.0 | A |
| | 18 | 0.74 | 1.09 | 160 | <1.005 | fracture | A |
| | 19 | 0.58 | 0.64 | 105 | <1.005 | 0 | A |
| | 20 | 0.44 | 0.62 | 115 | <1.005 | 0 | A |
| | 21 | 0.31 | 0.85 | 140 | 1.05 | 0 | A |
| | 22 | 0.31 | 0.97 | 145 | 2.20 | 0 | A |
| | 23 | 0.46 | 0.79 | 142 | 1.02 | 0 | A |
| | 24 | 0.49 | 0.82 | 149 | 1.15 | 0 | A |
| | 25 | 0.47 | 0.80 | 122 | >2.0 | 0 | A |
| | 26 | 0.42 | 0.76 | 129 | 2.0 | 0 | A |
| | 27 | 0.47 | 0.77 | — | — | — | B |
| | 28 | 0.66 | 0.97 | — | — | — | B |
| | 29 | 0.46 | 0.77 | 130 | <1.005 | 1.0 | A |
| | 30 | 0.45 | 0.78 | 115 | >2.0 | 0 | A |
| | 31 | 0.27 | 0.60 | 95 | >2.0 | 0 | A |
| | 32 | 0.33 | 0.63 | 101 | 1.2 | 0 | A |
| | 33 | 0.83 | 1.17 | — | — | — | C |
| | 34 | 0.28 | 0.65 | 115 | >2.0 | 0 | A |
| | 35 | 0.34 | 0.58 | 105 | 1.02 | 0 | A |
| | 36 | 0.23 | 0.49 | 96 | >2.0 | 0 | A |
| | 37 | 1.03 | 1.03 | 125 | <1.005 | fracture | A |
| | 38 | 0.40 | 0.46 | 91 | <1.005 | 0 | A |
| | 39 | 0.70 | 0.70 | 108 | <1.005 | 0 | A |
| | 40 | 0.50 | 0.80 | 115 | <1.005 | 0 | A |
| | 41 | 0.47 | 0.77 | 105 | <1.005 | 0 | A |
| Invention | 42 | 0.62 | 0.99 | 162 | <1.005 | 0 | A |
| | 43 | 0.57 | 0.83 | 149 | <1.005 | 0 | A |

Note:
A: good.
B: small cracks observed and lowered reduction of area.
C: large cracks observed.

As is apparent is from TABLES 1 and 2 as well as the accompanying drawings, Steel Nos. 1–14, 42 and 43, all according to this invention, had a 0.2% proof stress higher than 130 kgf/mm² and magnetic permeability smaller than 1.005. Thus, their non-magnetic properties were stable and they did not show any stress corrosion cracking and exhibited good hot workability. Contrary to the steel samples according to this invention, Comparative Steel Nos. 15, 16, 25, 30–32, and 34–36 had larger magnetic permeability and thus were not non-magnetic although they did not develop stress corrosion cracking and showed good hot workability. Their 0.2% proof stress values ranged from 95 to 120 kgf/mm² or so and they thus failed to provide high strength. Comparative Steel Nos. 17, 18 and 29 and a high level of 0.2% proof stress, were non-magnetic and showed good hot workability. However, they developed stress corrosion cracking. Comparative Steel Nos. 19, 20 and 38–41 were poor in 0.2% proof stress. Comparative Steel Nos. 21–24 had a high level of 0.2% proof stress, were free from stress corrosion cracking and exhibited good hot workability but they had larger magnetic permeability and did not show non-magnetic properties. Comparative Steel No. 26 had a large magnetic permeability, thus did not show non-magnetic property. Comparative Steel No. 37 showed stress corrosion cracking. Finally, Comparative Steel nos. 27, 28 and 33 were accompanied by forge cracking and were inferior in hot workability.

Therefore, the high strength steel samples according to this invention were far better than the comparative steel samples.

Having now fully described the invention, it will be apparent to one of ordinary skill in the art that many changes and modifications can be made thereto without departing from the spirit or scope of the invention as set forth herein.

What is claimed is:

1. High strength austenitic steel having excellent cold work hardenability, consisting essentially of the following elements:

C . . . 0.1–0.3 wt.%;
Si . . . a positive amount and up to 1.5 wt.%;
Mn . . . 16–22 wt.%;
Cr . . . 14–18 wt.%;
V . . . 0.8–1.7 wt.%;

N . . . 0.3–0.6 wt.%;

Ni . . . less than 0.8 wt.%; and

Fe and inevitable impurities . . . balance, with a proviso that the C-, N- and V-contents satisfy the following inequalities:

$C+N-(V/10) \geqq 0.4$ wt.%; and $C+N+(V/5) \geqq 0.75$ wt.%.

2. High strength austenitic steel having excellent cold work hardenability, consisting essentially of the following elements:

C . . . 0.1–0.3 wt.%;

Si . . . up to 1.5 wt.%;

Mn . . . 16–22 wt.%;

Cr . . . 14–18 wt.%;

V . . . 0.8–1.7 wt.%;

N . . . 0.3–0.6 wt.%;

Ni . . . less than 0.8 wt.%;

at least one of

Ti and Nb . . . 0.05–1.0 wt.% (each); and

Fe and inevitable impurities . . . balance, with a proviso that the C-, N- and V-contents satisfy the following in equalities:

$C+N-(V/10) \geqq 0.4$ wt.%; and $C+N+(V/5) \geqq 0.75$ wt.%.

3. The high strength austenitic steel as claimed in claim 1 or 2, having a 0.2% proof stress of 130 kgf/mm$^2$ or higher.

* * * * *